US008277640B2

(12) United States Patent
Tamagawa et al.

(10) Patent No.: US 8,277,640 B2
(45) Date of Patent: Oct. 2, 2012

(54) THERMAL CRACKING PROCESS AND FACILITY FOR HEAVY PETROLEUM OIL

(75) Inventors: Atsushi Tamagawa, Yokohama (JP); Makoto Nomura, Yokohama (JP); Isao Shibutani, Yokohama (JP); Keiji Maehara, Yokohama (JP); Hisao Takeuchi, Sodegaura (JP)

(73) Assignees: Chiyoda Corporation, Yokohama-Shi (JP); Fuji Oil Co., Ltd., Sodegaura-Shi (JP)

( * ) Notice: Subject to any disclaimer, the term of this patent is extended or adjusted under 35 U.S.C. 154(b) by 813 days.

(21) Appl. No.: 12/439,478

(22) PCT Filed: Aug. 29, 2007

(86) PCT No.: PCT/JP2007/066753

§ 371 (c)(1),
(2), (4) Date: Mar. 26, 2009

(87) PCT Pub. No.: WO2008/038490

PCT Pub. Date: Apr. 3, 2008

(65) Prior Publication Data

US 2010/0018897 A1 Jan. 28, 2010

(30) Foreign Application Priority Data

Sep. 28, 2006 (JP) ..... 2006-264138

(51) Int. Cl.
*C10G 9/36* (2006.01)

(52) U.S. Cl. ..... 208/130

(58) Field of Classification Search ..... 208/106, 208/125, 128, 130, 131, 132
See application file for complete search history.

(56) References Cited

U.S. PATENT DOCUMENTS 3,928,170 A 12/1975 Takahashi et al.
4,214,979 A 7/1980 Nakanishi et al.
4,242,196 A * 12/1980 Aiba et al. ..... 208/40
4,522,703 A * 6/1985 Yan et al. ..... 208/40

FOREIGN PATENT DOCUMENTS

GB 1 391 490 A 4/1975

(Continued)

OTHER PUBLICATIONS

International Preliminary Report on Patentability and the Written Opinion of the International Searching Authority, International Application No. PCT/JP2007/066753 mailed Apr. 9, 2009.

*Primary Examiner* — Randy Boyer
(74) *Attorney, Agent, or Firm* — Birch, Stewart, Kolasch & Birch, LLP

(57) ABSTRACT

The present invention relates to a process for thermal cracking of heavy petroleum oil, in which when a thermal cracking facility having a cracking furnace, two or more of trains each comprising two reaction vessels and one distillation tower is operated, each train is operated by repeating a cycle comprising drawing the heavy petroleum oil from the cracking furnace, feeding the drawn heavy petroleum oil into the first reaction vessel and then feeding the drawn heavy petroleum oil into the second reaction vessel, steam is directly brought in contact with the heavy petroleum oil to be thermally cracked, and gaseous cracked substances produced and steam are introduced into the distillation tower to be distilled and separated, wherein phase delay is provided for the cycle repeated in each train so that the thermal cracking facility is operated with the different initiation time of feeding to the first reaction vessel in each train. According to the present invention, the instability of the flow-in quantity of the gaseous substances to the distillation tower is improved, and the improvement of separation performance, the increase of processing capacity of the facility and the like can be achieved.

3 Claims, 4 Drawing Sheets

FOREIGN PATENT DOCUMENTS

| | | | |
|---|---|---|---|
| GB | 1 557 809 | | 12/1979 |
| JP | 59-109590 | A | 6/1984 |
| JP | 2-43285 | A | 2/1990 |
| JP | 7-116450 | A | 5/1995 |
| JP | 11-263982 | A | 9/1999 |
| WO | WO 84/00035 | A1 | 1/1984 |

* cited by examiner

THERMAL CRACKING PROCESS AND FACILITY FOR HEAVY PETROLEUM OIL

TECHNICAL FIELD

The present invention relates to a processing technology for continuous thermal cracking of heavy petroleum oil and the physical processing facility to realize the technology.

BACKGROUND ART

Heavy or residual petroleum oils of high sulfur content such as petroleum asphalt are less valuable because of their serious impact on the environment when directly burnt as fuel. Therefore, these heavy or residual petroleum oils are generally used as useful industrial feed-stocks after transformed into lighter products by cracking. As one of these technologies, the following process scheme of thermal cracking and its facility are mentioned.

As a processing scheme for thermal cracking of heavy petroleum oil, there is a proposed scheme consisted of a cracking furnace and a reaction vessel in which the heavy oil fed through the cracking furnace is introduced into the reaction vessel to be thermally cracked (refer to Patent Documents 1 to 4). The heavy petroleum oil fed to the reaction vessel is directly contacted with superheated steam of 500 to 700° C. that is blown into from the bottom of the reaction vessel. Heavy petroleum oil in the reaction vessel is thermally cracked and transformed into aliphatic hydrocarbons rich gaseous cracked substances and poly-aromatics rich petroleum pitch. The gaseous cracked substances are discharged from the top outlet of the reaction vessel together with steam and introduced into the distillation tower for separation.

As represented typically in the Patent Documents 1 to 4, there is proposed a process scheme in which one cracking furnace and two reaction vessels are provided. Heavy petroleum oil fed through the cracking furnace is introduced into the first reaction vessel, and then introduced into the second reaction vessel after feeding to the first reaction vessel is completed. Feeding to the reaction vessels is switched alternately so that the heavy petroleum oil is thermally cracked semi-continuously.

In these thermal cracking processes, the heavy petroleum oil fed to the reaction vessel is directly contacted with superheated steam blown into from the bottom of the reaction vessel and thermally cracked to produce aliphatic hydrocarbons rich gaseous cracked substances and poly-aromatics rich petroleum pitch. The gaseous cracked substances are discharged from the top outlet of the reaction vessel together with steam and introduced into the distillation tower for separation. However, since the thermal cracking process in reaction vessels is batch-wise operation, the amount of gaseous cracked substances discharged from the reaction vessels is not constant but fluctuated through cycles. Accordingly, the flow-rate of the gaseous substances charged to the distillation tower is varied greatly with variation range of not less than 25% occasionally. This fluctuation of the flow-in quantity of the gaseous substances causes unstable operation of the distillation tower and results in inferior separation performance or reduced operation of the upstream cracking section.

In addition, gaseous substances flown into the distillation tower contains carried-over pitch that is the precursor of coke. In order to prevent the precursor of coke from contaminating into the product oil it is necessary to supply adequate quantity of wash oil in the lower section of the tower matching the flow-in quantity of the gaseous substances. In this situation, when there is a fluctuation of the flow-in quantity of the gaseous substances, it is unpractical to change the quantity of wash oil depending on the feed fluctuation. It is also economically undesirable to supply constant quantity of wash oil matching the maximum flow-in quantity of the gaseous substances.

Further, since the latent heat of vaporization and sensible heat of gaseous substances is recovered simultaneously in the distillation tower, quantity of steam generated from the heat recovery system is fluctuated. Consequently, operation of the refinery boiler plant is affected by this fluctuation. Therefore, uniformity of the flow-in quantity of the gaseous substances to the distillation tower has been desired.

Further, in order to increase the cracking capacity of heavy oil, it can be usual way to increase the capacity of without increasing number of equipment such as furnace, reaction vessel and distillation tower. However, range of fluctuation of the feed to the distillation tower might be enlarged more in the following revamping cases.

Capacity increase with the same number of reaction vessel

Addition of new cracking train of 2 reaction vessels with simultaneous feed to the first reaction vessel.

The term "cycle" used in the present invention means the interval from starting of the feed through the furnace to the first reaction vessel to the completion of feed to the second reaction vessel and re-starting of feed to the first reaction vessel for each cracking train.

[Patent Document 1] JP07-116450 B (1995)
[Patent Document 2] JP54-15444 B (1979)
[Patent Document 3] JP57-15795 B (1982)
[Patent Document 4] JP63-38076 B (1988)

DISCLOSURE OF THE INVENTION

Problems to be Solved by the Invention

Consequently, it is the object of the present invention to provide a process for thermal cracking of heavy petroleum oil which enables improved separation performance of the distillation tower, increased through-put capacity, stable and steady operation and reduced quantity of wash oil in the lower section of the distillation tower by improving unstable and fluctuating flow of gaseous substances from the reaction vessels to the distillation tower.

Means for Solving Problems

The above-mentioned object is attained by the invention below.

Namely, the present invention relates to a process for thermal cracking of heavy petroleum oil (hereinafter, often referred to as merely the "thermal cracking process of the invention"), in which when a thermal cracking facility having a cracking furnace to heat the heavy petroleum oil, two or more of trains each comprising first and second reaction vessels to which the heavy petroleum oil heated in the cracking furnace is introduced and one distillation tower to separate gaseous substances discharged from the respective reaction vessels of each train is operated, each train is operated by repeating a cycle comprising drawing the heavy petroleum oil from the cracking furnace, feeding the drawn heavy petroleum oil into the first reaction vessel and feeding the drawn heavy petroleum oil into the second reaction vessel after completion of feeding the drawn heavy petroleum oil into the first reaction vessel, steam is blown into each reaction vessel from the bottom of each reaction vessel while feeding the heavy petroleum oil and is directly brought in contact with the heavy petroleum oil to be thermally cracked, gaseous cracked substances produced and steam in each reaction vessel are discharged from the top outlet of each reaction vessel to be introduced into the distillation tower, and separation by distillation is carried out in the distillation tower, wherein phase delay is provided for the cycle repeated in each train so that the thermal cracking facility is operated with the different initiation time of feeding to the first reaction vessel in each train.

According to the thermal cracking process of the invention, the fluctuating amount of gaseous substances (gaseous cracked substances and steam) discharged from each train of the reaction vessels with a specific period is equalized as the total amount by providing phase delay between the respective train of the reaction vessels and the fluctuation of the total amount of the gaseous substances charged to the distillation tower can be reduced.

Since the total amount of the gaseous substances discharged from the reaction vessels is thus equalized, outstanding issues such as inferior separation performance of a distillation tower, bottleneck for increasing cracking capacity, unstable operation, and further, the excessive consumption of wash oil in the lower section of the distillation tower can be solved. These improvements are linked to the improvement of the process performance of the thermal cracking of heavy petroleum oil and also the improvement of through-put capacity of the thermal cracking facility as a whole.

As to the preferable level of the phase delay between the respective train of reaction vessels for the fluctuating gaseous substances with certain period, phase delay should be determined so that the peak times of the trains are not overlapped each other. It is more preferable to determine the phase delay so that the peak time of the train is completely overlapped to the bottom time of the other train. However, even if the peak time is not completely overlapped to the bottom time of the other train, the effect of the invention of the present application can fully be expected. Therefore, there is no upper limit for the number of the reaction vessel train from this viewpoint.

Since the specific time of the phase delay between the respective reaction vessel train is also dependent on feeding time into a reaction vessel, quantity of raw material to be fed (heavy petroleum oil), size of the facility, number of reaction vessel train, it is difficult to specify it as a general value. However, it is simple and efficient to determine the phase delay as a half of the time required for feeding of one reaction vessel in case of two trains, namely, a quarter of the forementioned cycle time, ⅙ of the cycle time in case of three trains and ½n of the cycle time in case of n trains.

By using thermal cracking process of this invention, the fluctuation of the total flow rate of the gaseous cracked substances and steam (gaseous substances) that are discharged from the top outlet of each reaction vessel and then introduced into the distillation tower can be reduced to the level of 15% or less and preferably to the level of 5% or less.

As to the cracking furnace, it is preferable to have one cracking furnace for each train and each cracking furnace is mutually independent so that the heavy petroleum oil can be individually introduced into all the reaction vessels of each train. In particular, it is preferable from the viewpoint of operation flexibility to have an idle furnace independent from the operating reaction vessel trains so that the coked-up furnace can be brought in decoking operation while normal operation can be continued by switching the idle furnace into service.

On the other hand, a thermal cracking facility for heavy petroleum oil of the present invention (hereinafter, often referred to as merely the "thermal cracking reaction vessel of the invention" or the "thermal cracking facility of the invention") is characterized in that the thermal cracking facility for heavy petroleum oil having a cracking furnace to heat the heavy petroleum oil, two or more of trains comprising first and second reaction vessels to which the heavy petroleum oil heated in the cracking furnace is introduced and one distillation tower to separate gaseous substances discharged from the respective reaction vessels in each train, wherein each train is operated by repeating a cycle comprising drawing the heavy petroleum oil from the cracking furnace, feeding the drawn heavy petroleum oil into the first reaction vessel and feeding the drawn heavy petroleum oil into the second reaction vessel after completion of feeding the drawn heavy petroleum oil into the first reaction vessel, steam is blown into each reaction vessel from the bottom of each reaction vessel while feeding the heavy petroleum oil and is directly brought in contact with the heavy petroleum oil to be thermally cracked, gaseous cracked substances produced and steam in each reaction vessel are discharged from the top outlet of each reaction vessel to be introduced into the distillation tower, and separation by distillation is carried out in the distillation tower, and wherein phase delay is provided for the cycle repeated in each train so that the facility is operated with the different initiation time of feeding to the first reaction vessel in each train.

In the thermal cracking facility of the invention, the fluctuation of the total flow rate of the gaseous cracked substances and steam that are discharged from the top outlet of each reaction vessel and are introduced into the distillation tower can be reduced to the level of 15% or less and preferably to the level of 5% or less.

As to the cracking furnace, it is preferable to have one cracking furnace for each train and each cracking furnace is mutually independent so that the heavy petroleum oil can be individually introduced into all the reaction vessels of each train. In particular, it is preferable from the viewpoint of operation flexibility to have an idle furnace independent from the operating reaction vessel trains so that the coked-up furnace can be brought in decoking operation while normal operation can be continued by switching the idle furnace into service.

Effect of the Invention

According to the process for thermal cracking of heavy petroleum oil and the thermal cracking facility of the present invention, since the number of trains is not less than two and phase delay is provided for the cycle repeated in each train, the instability of the flow-in quantity of the gaseous substances to the distillation tower can be improved, and also improvement of the separation performance of a distillation tower, increase of the cracking capacity, stable operation, and reduction of the quantity of wash oil in the lower section of the tower are attained. Further, the improvement of the process performance for thermal cracking of heavy petroleum oil and the throughput capacity of the whole thermal cracking facility can be realized by these improvements.

EXPLANATION OF NUMERALS

Figure 1:
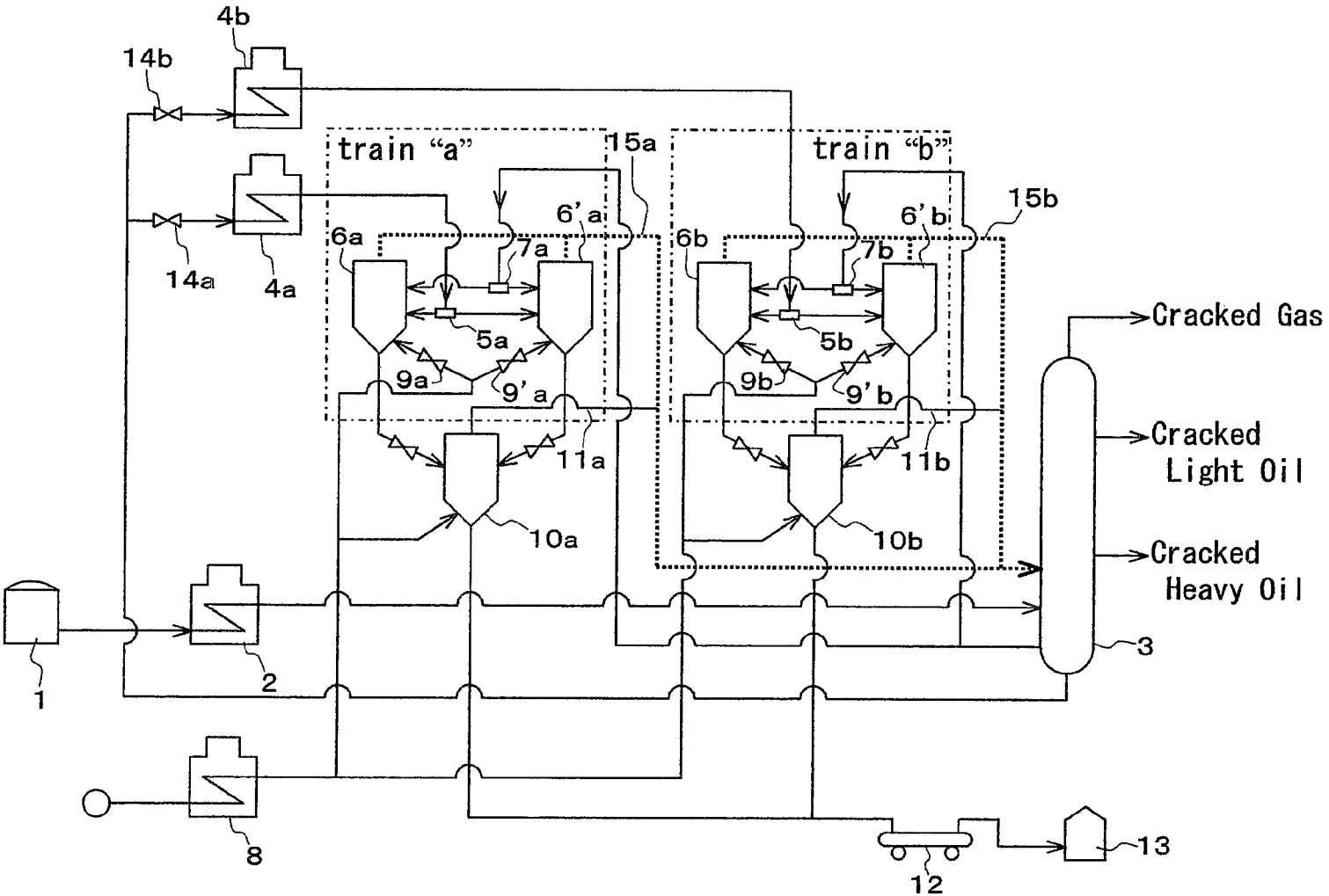
FIG. 1 is a flow sheet illustrating the whole constituent of the thermal cracking process for heavy petroleum oil and the thermal cracking facility of the invention.

1: Raw material tank
2: Preheating furnace of raw material
3: Distillation tower
4: Tubular cracking furnace (Cracking furnace)
5, 7, 14: Switching valve
6: Reaction vessel
8: Steam super-heater
9: Valve
10: Liquid pitch storage vessel
11: Line
12: Pitch-solidifying facility
13: Post pitch storage facility
14: Introduction valve
15: Piping

BEST MODES FOR CARRYING OUT THE INVENTION

The invention is illustrated below in detail according to the drawings.

Firstly, the process for thermal cracking of heavy petroleum oil and the thermal cracking facility of the invention are illustrated in detail according to the drawings, describing the mode of operation that is one exemplary mode of the invention. Further, the mode of operation below is an example in which the two trains each comprising two reaction vessels.

FIG. 1 is a flow sheet for illustrating the whole constituent of the present mode of operation.

Raw material (heavy petroleum oil) fed from a raw material tank 1 is preliminarily heated-up to about 350° C. by the raw material-preheating furnace 2 and then charged to the bottom section of the distillation tower 3. Here-at, it is mixed with the heavy end fraction of cracked oil that is dropped to a tower bottom as recycle oil. A ratio of the recycle oil to the raw material is 0.05 to 0.25 and preferably 0.10 to 0.20.

The raw material mixed with the recycle oil is fed to each of the tubular cracking furnaces (heating furnaces) 4*a* and 4*b* through inlet valves 14*a* and 14*b*. The raw material is heated-up to 480 to 500° C. and preferably 490 to 500° C. in the tubular cracking furnaces 4*a* and 4*b* to be thermally cracked. The outlet pressure of each cracking furnace 4*a* and 4*b* is around atmospheric pressure to 0.4 MPa. The reaction time in the tubular cracking furnace is usually 0.5 to 10 minutes and preferably 2 to 5 minutes.

The oil heated in the tubular cracking furnace 4*a* is introduced into the train "a" and the oil heated in the tubular cracking furnace 4*b* is introduced into the train "b" respectively. Further, each train of "a" and "b" is consisted of two reaction vessels, i.e. the first reaction vessels 6*a* and 6*b* and the second reaction vessels 6'*a* and 6'*b*.

Although the trains of "a" and "b" are illustrated below both together, either of each train can be operated independently.

The thermally cracked products (heavy petroleum oil) at high temperature that passed through the tubular cracking furnaces 4*a* and 4*b* are introduced into the predetermined reaction vessels (thermal cracking reaction vessels) 6*a*, 6'*a*, 6*b* and 6'*b* through the switching valves 5*a* and 5*b* while being flashed. Prior to the introduction of furnace effluent to the reaction vessels, it is preferable to feed preliminarily certain part of the raw material into the reaction vessels from the bottom of the distillation tower 3 through the switching valves 7*a* and 7*b* (preliminary feeding). The quantity of the preliminary feeding in each reaction vessel 6*a*, 6'*a*, 6*b* or 6'*b* is 5 to 18% by volume of the total quantity of feeding in each reaction vessel 6*a*, 6'*a*, 6*b* or 6'*b*, preferably 10 to 15% by volume. Further, the temperature of the raw material during the preliminary feeding is about 340° C.

Each of the switching valves 5*a*, 5*b*, 7*a* and 7*b* is actuated with constant interval and the raw material of the preliminary feeding and the thermal cracked products from the tubular cracking furnaces 4*a* and 4*b* are charged periodically and alternately into each pair of the reaction vessels 6*a* and 6'*a* or 6*b* and 6'*b* of the train "a" and "b". By this periodical operation thermal cracking process of the thermal cracked products continuously fed from the tubular cracking furnaces 4*a* and 4*b* is continuously carried out in the reaction vessels.

The reaction vessels 6*a*, 6'*a*, 6*b* and 6'*b* are vertical cylindrical vessels with squeezed bottom (a shape in which the shell diameter of cylindrical vessel becomes narrow toward the bottom section) and are provided with a raw material inlet, a heat medium gas inlet, a cracked gas outlet, a cracked oil and heat medium gas outlet, and a residual products taking-out nozzle. Further, a mixer can be provided if necessary.

Superheated steam heated by the steam super-heater 8 up to 400 to 700° C. is blown into the reaction vessels 6*a*, 6'*a*, 6*b* and 6'*b* as heat medium gas though the valves 9*a*, 9'*a*, 9*b* and 9'*b*.

When the thermal cracked products from the tubular cracking furnaces 4*a* and 4*b* are fed into the reaction vessels 6*a*, 6'*a*, 6*b* and 6'*b*, the temperature of the preliminary fed material in the reaction vessels 6*a*, 6'*a*, 6*b* and 6'*b* just before feeding through the furnace is about 340° C. The temperature in the reaction vessels is raised-up to 430 to 440° C., and then further cracking and polymerization-condensation reactions of thermal cracked products occur in the reaction vessels at the same time when introduced into the vessels.

The period of one feeding batch is preferably set 50 to 120 minutes, and more preferably 60 to 90 minutes. The softening point of the residual product in the vessels (hereinafter, often referred to merely as "pitch") is raised at the completion of the feeding. The reactions in the reaction vessels are proceeded further by continuing the blowing-in of the superheated steam after completion of the feeding. It is preferable that the reaction time after feeding is specified in the range of 15% to 45% of the feeding time, and more preferably 25% to 45%.

Since the thermally cracked products from the tubular cracking furnaces 4*a* and 4*b* are subject to thermal cracking reaction and also their temperature is high enough, it is hardly required to have reaction time (retention time) after the feeding. However, when the feeding time for the reaction vessels 6*a*, 6'*a*, 6*b* and 6'*b* is extended, the pitch thus obtained is likely to be less homogeneous. Accordingly, the feeding time is limited to be 50 to 120 minutes in order to obtain homogeneous pitch and the thermal cracking process is continued by continuing superheated steam injection for period of 15 to 45% of the feeding time after completion of the feeding.

Relatively low temperature steam can be used as superheated steam fed to the reaction vessels 6*a*, 6'*a*, 6*b* and 6'*b* since its temperature is 400 to 700° C. Further, a required quantity of steam is not so much. It is sufficient to supply 0.08 to 0.15 kg steam per 1 kg of the total quantity of the raw material charged to the tubular cracking furnaces 4*a* and 4*b* and the reaction vessels 6*a*, 6'*a*, 6*b* and 6'*b*.

The gaseous cracked substances and steam contained in the thermal cracked products are discharged from the top outlet of the reaction vessels 6*a*, 6'*a*, 6*b* and 6'*b* during the feeding of the thermal cracked products from the tubular cracking furnaces 4*a* and 4*b* and also during the cracking reaction thereafter are fed to the distillation tower 3 through delivery pipings 15*a* and 15*b* to the distillation tower that is shown by a dotted line.

After completion of the reaction in the reaction vessels 6*a*, 6'*a*, 6*b* and 6'*b*, the cooling (quenching) of the reaction vessels 6*a*, 6'*a*, 6*b* and 6'*b* is started, the temperature of the reaction vessels 6*a*, 6'*a*, 6*b* and 6'*b* is lowered to 320 to 380° C. to substantially complete the reaction and then, the pitch in the reaction vessels 6*a*, 6'*a*, 6*b* and 6'*b* are immediately transferred to liquid pitch storage vessels 10*a* and 10*b*. The liquid pitch storage vessels 10*a* and 10*b* have stirrers and also have functions to receive pitch alternately from the reaction vessels 6*a*, 6'*a*, 6*b* and 6'*b* and to mix them uniformly. Further, superheated steam is blown in from their bottom, and the temperature of pitch in the vessels is retained at 300 to 370° C. to keep the pitch in liquid state. Light distillate stripped off from the pitch is fed to the distillation tower 3 through the lines 11*a* and 11*b*. The pitch in the liquid pitch storage vessels 10*a* and 10*b* is delivered to a solid pitch storage facility 13 after being cooled down and solidified in a pitch solidification facility 12.

Figure 2:
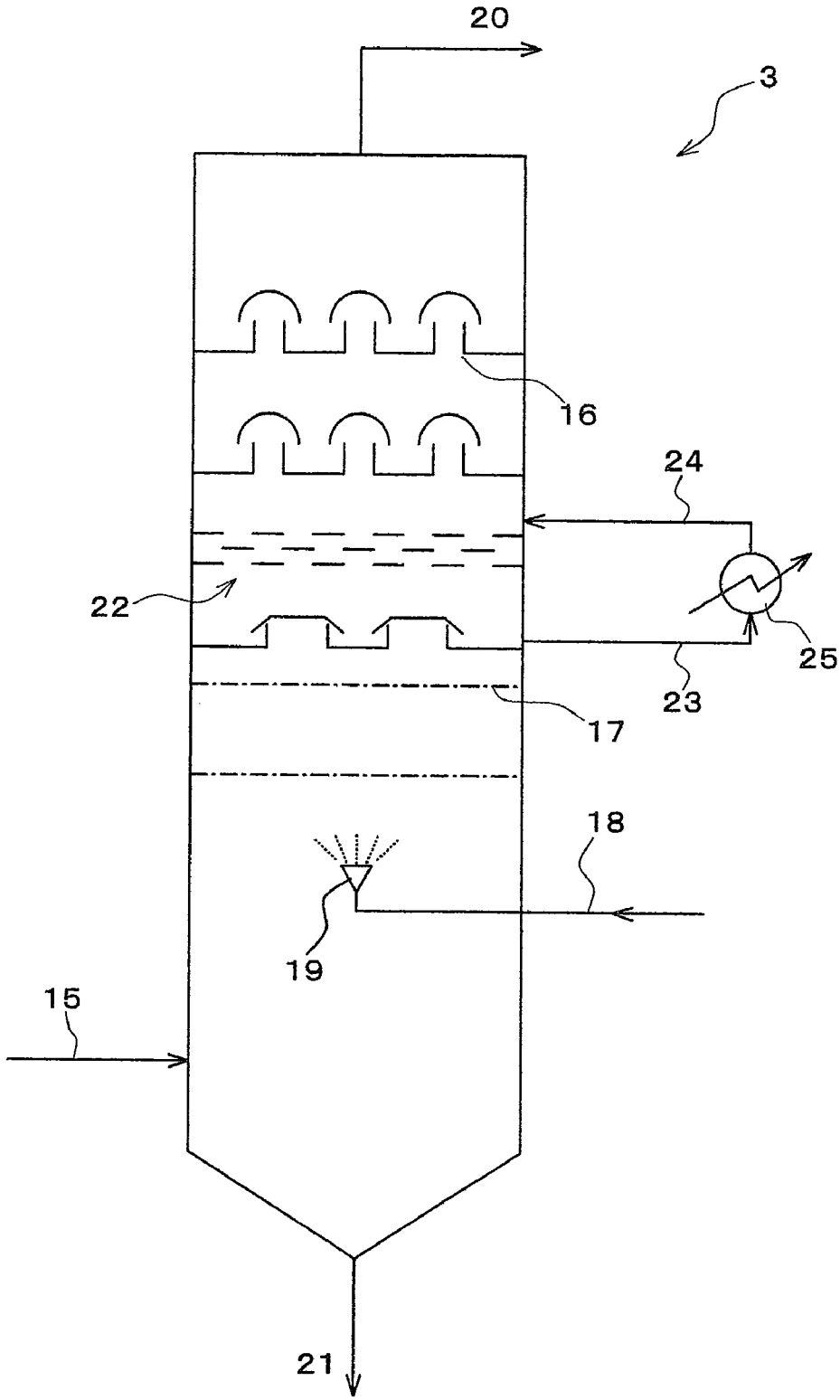
FIG. 2 is a schematic drawing of a distillation tower shown in FIG. 1.

FIG. 2 shows the schematic drawing of the distillation tower 3. The gaseous substances comprising gaseous cracked substances and steam fed through the transfer lines 15*a* and 15*b* are introduced into the distillation tower 3 from the feed tube 15 at a temperature of about 400 to 450° C. The pitch fraction entrained with the gaseous substances is removed in the lower section of the distillation tower 3.

The inside of the distillation tower 3 is composed of a fractionation section equipped with bubble cap trays 16, a heat recovery section equipped with baffle trays 22, a wash oil section equipped with sieve trays 17 and wash oil transfer pipe 18 with jet nozzles 19 at the end. Type of the wash oil is not specifically limited, but oil of liquid state at 200 to 300° C., for example, gas oil or cracked heavy oil is usually used.

The quantity of the wash oil is preferably within the range of 0.005 to 0.05 k-mol per 1 k-mol of the gaseous substances and more preferably within the range of 0.01 to 0.02 k-mol.

The pitch is removed from the gaseous substances by the distillation tower 3 having the above mentioned composition. The pitch removed is discharged from the bottom of the distillation tower 3 through the discharge pipe 21. The gaseous substances from which the pitch was removed rise up in the distillation tower 3 and are distilled out from the discharge pipe 20 at the top, passing through the heat recovery section consisted of cracked heavy oil inlet pipe 24 located in the center of tower 3, draw-off pipe 23, heat exchanger 25 and baffle trays 22, and then oil fractionation section consisted of bubble cap trays 16. The gaseous substances are separated into cracked gas, cracked light oil and cracked heavy oil by this distillation operation and are sent to the next step for further processing.

What described above is the whole scheme of the demonstration. As shown in FIG. 1, in addition to the two sets of train a and b each comprising two reaction vessels, the tubular cracking furnaces (heating furnaces) 4*a* and 4*b*, the liquid pitch storage vessels 10*a* and 10*b* and other various auxiliary equipment is provided for the respective trains.

Figure 3:
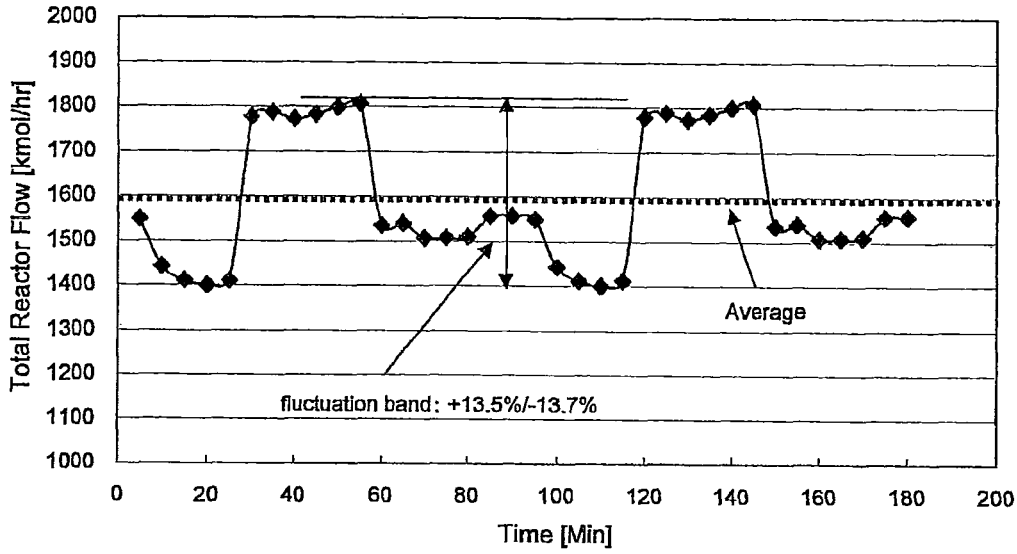
FIG. 3 is a graph showing the measured total flow rate of gaseous substances with time processed obtained in a conventional thermal cracking process and a conventional thermal cracking facility. Horizontal axis is time processed from the initiation of feeding and longitudinal axis is the total hourly flow rate of the gaseous substances discharged.

Here-at, the total flow rate of the gaseous substances (gaseous cracked substances and steam) that are fed from the reaction vessels 6*a* and 6'*a* through the transfer piping 15*a* to the distillation tower 3 was measured with time elapsed, under the conditions that single train "a" of a conventional thermal cracking process and the thermal cracking facility is in operation. The result is shown in the graph of FIG. 3. In the graph of FIG. 3, the horizontal axis is process time from the initiation of feeding and the longitudinal axis is the total flow rate of the gaseous substances per hour (same in FIGS. 4 and 5).

Further, the operation conditions under which the result of measurements shown in the graph of FIG. 3 was obtained are as shown in Table 1 below.

TABLE 1

| | | |
|---|---|---|
| Distillation Tower 3 | Ratio of mixed recycle oil to raw material | 0.16 |
| Tubular cracking furnace 4a | Outlet pressure | 0.3 MPa |
| | Reaction time | 2 min. |
| Reaction vessels 6a and 6'a | Percentage of preliminary feeding quantity to total feeding quantity | 14% |
| | Temperature of superheated steam | 650° C. |
| | Feed quantity of superheated steam (percentage of steam to 1 kg of raw material oil) | 10% |
| | feeding time | 90 min. |
| Whole train a | Cycle time | 180 min./cycle |

As shown in the graph of FIG. 3, it is found that the peak time (about 1800 k-mol/hr) and the bottom time (about 1400 k-mol/hr) of the total hourly flow rate of the gaseous substances is periodically (with constant cycle) repeated. The average value of the total hourly flow rate of the gaseous substances is 1600 k-mol but it is separated by +13.5% from the peak and by −13.7% from the bottom and the range of fluctuation reaches 27.2%. It is found that the total hourly flow rate of the gaseous substances is repeating great fluctuation with a constant cycle.

Thus, since the flow of the gaseous substances to the distillation tower 3 is greatly fluctuated in case of single train, it causes unstable operation and troubles such as inferior separation performance or undesirable reduced operation of the thermal cracking facility.

In this mode of demonstration, two sets of train a and b are provided and they are operated in combination with phase delay of the feeding cycle into the reaction vessels.

Figure 4:
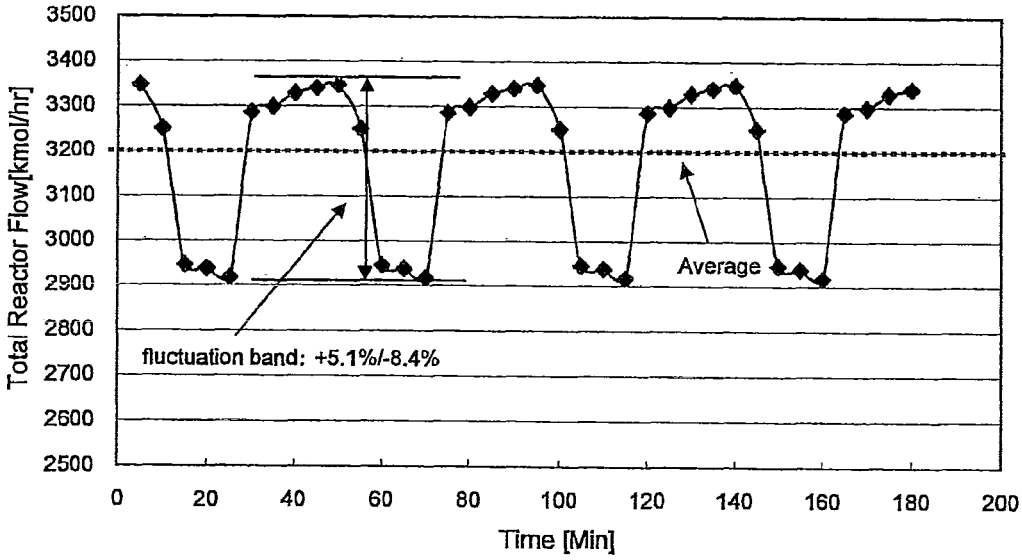
FIG. 4 is shown as one exemplary mode of the invention. The graph is showing the result obtained by measuring the total flow rate of gaseous substances with time processed in the thermal cracking process and the thermal cracking facility of two trains. Horizontal axis is time elapsed from the initiation of feeding and longitudinal axis is the total flow rate of the gaseous substances discharged per hour.

The total flow rate of the gaseous substances (gaseous cracked substances and steam) that are fed from the reaction vessels 6*a*, 6'*a*, 6*b* and 6'*b* through the transfer pipings 15*a* and 15*b* to the distillation tower 3 was measured with time elapsed, under the conditions that the thermal cracking process and the thermal cracking facility of the invention was in operation that both of the trains "a" and "b" downstream of the inlet valves 14*a* and 14*b* are operated under the same conditions as those shown in the graph of FIG. 3. The result is shown in the graph of FIG. 4. Further, the switching valves 5*a* and 5*b* were controlled so that the initiation time of feeding to the first reaction vessel 6*b* of the train "b" was delayed by 4 to 5 minutes (the phase delay was 45 minutes) from the initiation time of feeding to the first reaction vessel 6*a* of the train "a".

As shown in the graph of FIG. 4, the average value of the total hourly flow rate of the gaseous substances is 3200 k-mol, variations from the average value are +5.1% at the peak and −8.4% at the bottom and maximum range of variation is reduced to 13.5%.

The discharged quantity of the gaseous substances that repeats fluctuations with a specific cycle in the respective cycles of the trains "a" and "b" is uniformed as the total quantity by providing phase delay between both of the trains "a" and "b", and the range of fluctuation of the total discharged quantity of the gaseous substances that are flown out from both of the trains "a" and "b" and are flown into the distillation tower 3 after merged can be reduced.

Further, in case the through-put capacity of the heavy petroleum oil is matched the operating capacity of 2-trains operation, the maximum flow rate of the gaseous substances continuously introduced into the distillation tower 3 is 3350 k-mol/hr (FIG. 4), while it is 3600 k-mol/hr (1800 k-mol×2 from FIG. 3) in case of 1-train operation. There is reduction of about 7% in the maximum flow rate in case of 2-train operation. Therefore, the wash oil quantity required for the maximum flow rate of the gaseous substances in the lower section of the distillation tower 3 that can be reduced.

Thus, since the uniformity of the total discharged quantity of the gaseous substances is realized, the improvement of the separation performance of a distillation tower 3, the increase of through-put capacity of the gaseous substances and stable operation, further, the reduction of the quantity of wash oil in the lower section of the distillation tower 3 are attained. Further, these improvements are linked to the improvement of the process performance of the thermal cracking of heavy petroleum oil and the processing capacity of the whole thermal cracking facility.

The process for thermal cracking of heavy petroleum oil and the thermal cracking facility of the invention are illustrated above describing preferable demonstration mode, but the invention is not limited to the compositions of the above-mentioned demonstration mode but those skilled in the art can carry out various substitutions and modifications by converting published technologies. For example, in the above-mentioned demonstration mode, an example of two trains system, "a" and "b" each comprising two reaction vessels was illustrated, but a system of three trains or more can be feasible.

Of course, even if any substitution and modification are carried out, it belongs to the technical scope of the invention so far as it is equipped with the compositions of the invention.

In the thermal cracking facility of the fore-mentioned embodiment shown in FIG. 1, verification tests similar to the graphs shown in FIGS. 3 and 4 were carried out for the thermal cracking facility of three trains in which one pair was added further to the tubular cracking furnaces 4*a* and 4*b*, trains a and b and the liquid pitch storage vessels 10*a* and 10*b*. Here-at, the additional tubular cracking furnaces, train and liquid pitch storage vessels were the same conditions as the tubular cracking furnaces 4*a* and 4*b*, the train a and b and the liquid pitch storage vessels 10*a* and 10*b* and were controlled so that phase delay (difference of the starting time of feeding to the first reaction vessel between trains) between respective trains was 30 minutes (phase delay was 30 minutes). The result is shown in the graph of FIG. 5.

Figure 5:
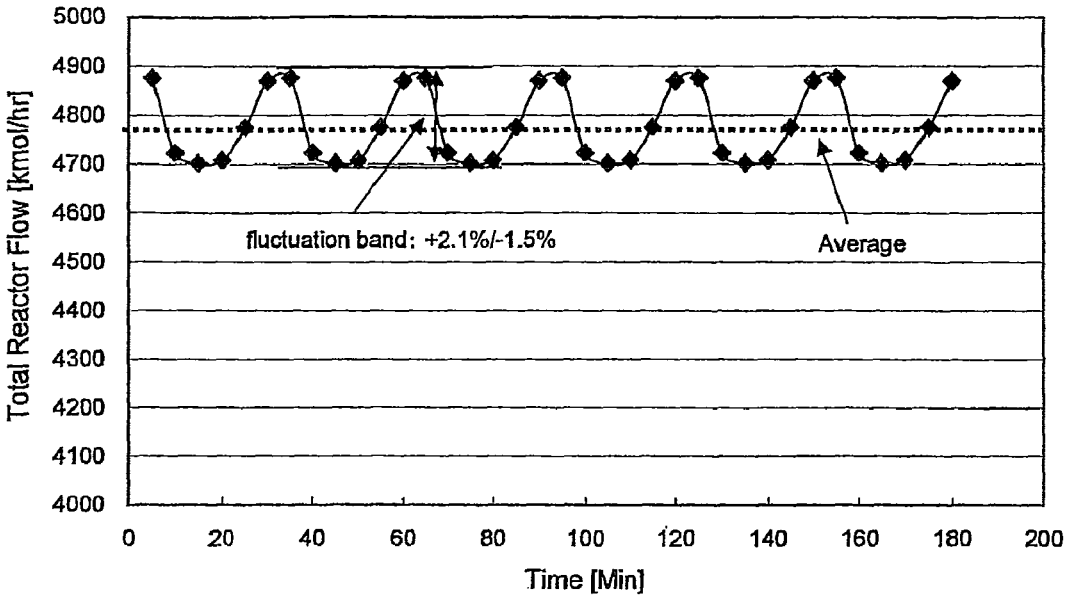
FIG. 5 is one exemplified mode of the invention and is a graph showing the result obtained by measuring the total flow rate of gaseous substances with time elapsed in the thermal cracking process and the thermal cracking facility of three trains. Horizontal axis is time elapsed from the initiation of feeding and the longitudinal axis is the hourly flow rate of the gaseous substances discharged.

As shown in the graph of FIG. 5, the average value of the total hourly flow rate of the gaseous substances is k-mol, variations from the average value are +2.1% at the peak and −1.5% at the bottom and maximum range of variation is greatly reduced to 3.6%.

The invention claimed is:

1. A process for thermal cracking of heavy petroleum oil, in which when a thermal cracking facility having a cracking furnace to heat the heavy petroleum oil, two or more of trains each comprising first and second reaction vessels to which the heavy petroleum oil heated in the cracking furnace is introduced and one distillation tower to separate gaseous substances discharged from the respective reaction vessels of each train is operated, each train is operated by repeating a cycle comprising drawing the heavy petroleum oil from the cracking furnace, feeding the drawn heavy petroleum oil into the first reaction vessel and feeding the drawn heavy petroleum oil into the second reaction vessel after completion of feeding the drawn heavy petroleum oil into the first reaction vessel, steam is blown into each reaction vessel from the bottom of each reaction vessel while feeding the heavy petroleum oil and is directly brought in contact with the heavy petroleum oil to be thermally cracked, gaseous cracked substances produced and steam in each reaction vessel are discharged from the top outlet of each reaction vessel to be introduced into the distillation tower, and separation by distillation is carried out in the distillation tower, wherein phase delay is provided for the cycle repeated in each train so that the thermal cracking facility is operated with the different initiation time of feeding to the first reaction vessel in each train.

2. The process for thermal cracking of heavy petroleum oil according to claim 1, wherein the range of fluctuation in the total flow rate of the gaseous cracked substances and steam that are discharged from the top outlet of each reaction vessel and introduced into the distillation tower is in 15% or less.

3. The process for thermal cracking of heavy petroleum oil according to claim 1 or 2, wherein the thermal cracking facility is provided with the same number of cracking furnaces as the number of trains and each cracking furnace is mutually independent.

* * * * *